114-253 MECH SR
11/6/84 OR 4,480,577

United States Patent [19]
Naypaver

[11] Patent Number: 4,480,577
[45] Date of Patent: Nov. 6, 1984

[54] WATER SKI APPARATUS

[76] Inventor: Frank R. Naypaver, 351 Florine Ave., Warren, Ohio 44430

[21] Appl. No.: 416,928

[22] Filed: Sep. 13, 1982

[51] Int. Cl.[3] ..... B63B 21/56
[52] U.S. Cl. ..... 114/253; 434/253
[58] Field of Search ..... 114/90, 230, 242, 250, 114/253, 254; 434/253; 280/491 B

[56] References Cited

U.S. PATENT DOCUMENTS

| | | | |
|---|---|---|---|
| 3,303,813 | 2/1967 | Collins et al. | 114/254 |
| 3,390,658 | 7/1968 | Ielks | 114/242 |
| 3,429,289 | 2/1969 | Lezak | 114/230 |

FOREIGN PATENT DOCUMENTS

| | | | |
|---|---|---|---|
| 1050918 | 12/1966 | United Kingdom | 114/90 |

OTHER PUBLICATIONS

"Barefoot Boom," Mastercraft Boat Company, Rt. 9, Box 152, Maryville, TN. (Advertisement).

*Primary Examiner*—Sherman D. Basinger
*Attorney, Agent, or Firm*—Michael Williams; Warren N. Low

[57] ABSTRACT

Apparatus for use with a boat, comprising an elongated bar having one end pivotally mounted on the side of the boat, the bar extending from the boat side so that a skier may grasp the opposite end of the bar or may tie his ski rope thereto. The bar is braced by means of a cable secured to an intermediate part of the bar and connected to a forward part of the boat, such as to the deck cleat. A further cable has one end connected to the bar and its other end connected to an upright mast. The pivot connection for the one end of the bar is in the form of a mounting plate which is secured to the side of the boat. The mounting plate has spaced ears between which the bar end is disposed, and a pin is disposed through holes in the ears and the bar end to provide a horizontal pivot.

7 Claims, 6 Drawing Figures

WATER SKI APPARATUS

BACKGROUND AND SUMMARY

Water skiing is gaining in popularity at a tremendous pace, but insofar as is known to the applicant, no satisfactory boat attachment is available to assist in the education and training of persons in the art of water skiing, either in elementary form or to raise the skill level of a person beyond the elementary form.

The prior art known to applicant consists of a bar or boom connected rigidly to the boat in position crosswise thereof. A skier holding on to a rigid boom always gets a lift therefrom and therefore has difficulty in establishing a feel of the water on his or her own.

Rigid booms also restrict the boat from passageways where the sides are closer together than the length of the boom. The rigid boom cannot be used on small bodies of water where the boat must be tightly turned and therefore highly banked, since the skier holding on to the boom is either yanked from the water or is dunked under the water surface, depending upon the side of the boat the skier is on during the turn made by the boat operator.

Apart from the rigid boom, the only other ski appatatus known to applicant is the familiar tow from the back of the boat. This type of tow is used in ski meets by experienced skiers. The inexperienced have great difficulty in learning to ski by being towed from the back of the boat because of wake produced by a speeding boat. This type of skiing can also be dangerous for the inexperienced skier since the boat propeller is at the stern of the boat and in case of a tow rope foulup, the skier may be hit by the propeller.

My invention makes it possible for a person to ski a short distance from the side of the boat and therefore be free of most of the wake. In carrying out my invention, an elongated bar is pivotally mounted at the boat side about a horizontally-disposed pivot so that the free end of the bar may move in a vertical direction. The bar is braced to withstand the pull of the skier but the bracing does not prevent vertical movement of the free end of the bar.

The beginning skier may be taught by a coach in the boat and since the skier is at the side of the boat, questions and instructions may be given at close quarters. Further, movies and photographs may be taken by the coach, or any other person, for instructional or other purposes.

Since the bar is permitted to swing vertically, the skier may place less and less reliance on the bar, as he or she gains confidence and experience and, after sufficient training, the skier is ready to enter meets where skiing is done by tow at the rear of the boat.

DESCRIPTION OF THE DRAWING

In the drawing accompanying this specification and forming a part of this application, there is shown, for purpose of illustration, an embodiment which my invention may assume and in this drawing.

DESCRIPTION OF THE PREFERRED EMBODIMENT

Figures 1, 2, 3, 4, 5, 6:
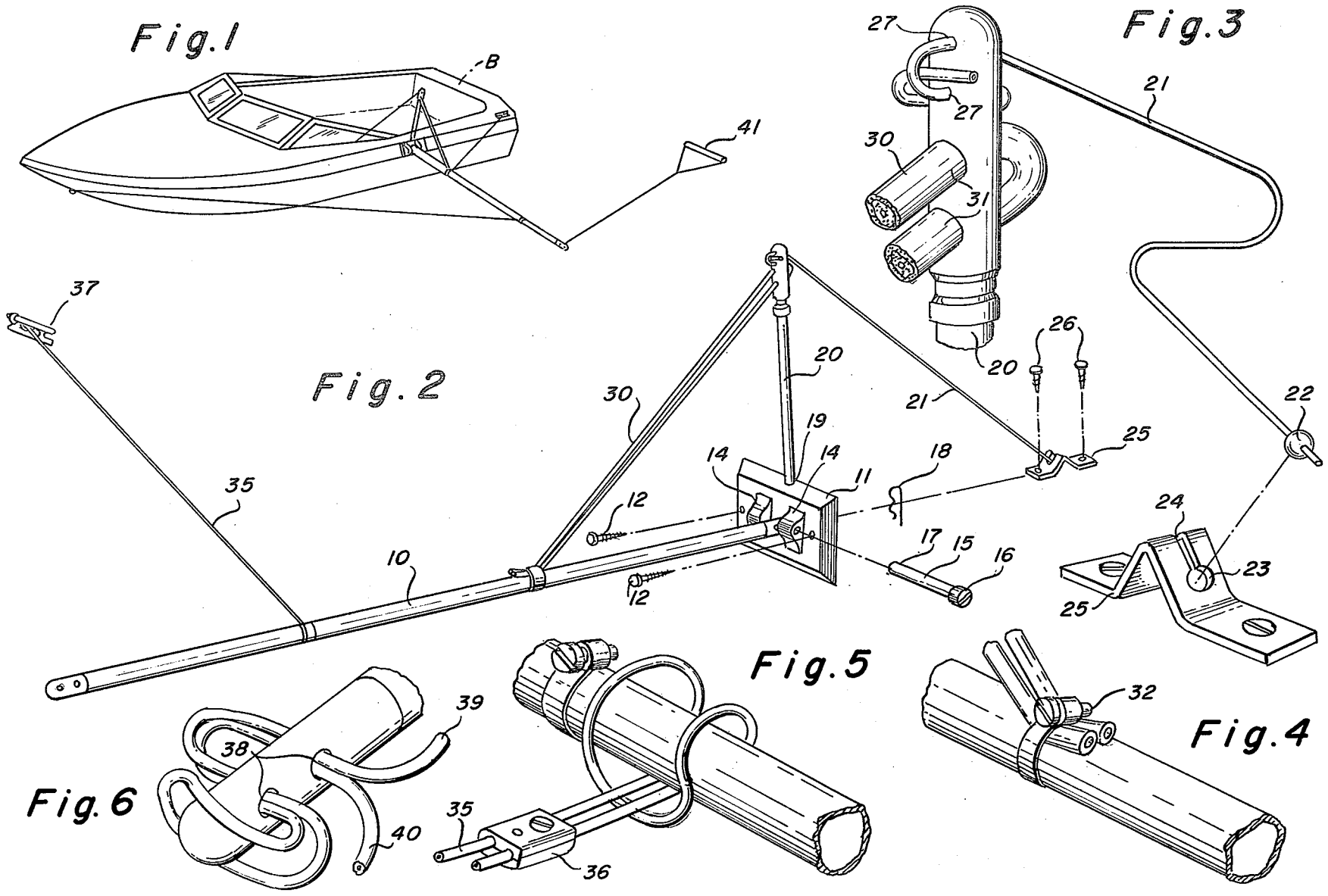
FIG. 1 is a small-scale perspective view of a boat with my improved attachment thereon.
FIG. 2 is a perspective view of parts comprising my invention, drawn to a larger scale.
FIGS. 3 through 6 are enlarged, fragmentary perspective views of connections between parts.

The preferred embodiment comprises an elongated bar or pole 10 (which may be of wood, aluminum or the like) having one end pivotally connected to the side of a boat B. The pivot connection comprises a mounting plate 11 adapted to be connected to the boat by means of screws 12 preferably at a distance about one foot above the water line. The plate has a pair of spaced ears 14 to receive therebetween the end of the bar 10. The ears and bar end are apertured to pass a pivot pin 15 which may have a head 16 at one end and a transverse aperture 17 at the other end to receive a cotter pin 18. The pivot pin provides a horizontal pivot axis so that the opposite, free end of the bar may move in a vertical direction. A skier may grasp the bar at any selected place inward of the bar end, or a ski rope may be tied to the end of the bar.

The mounting plate is of a substantial thickness and is formed with an opening 19 extending inwardly from an upper surface. The opening receives the lower end of a rigid support mast 20. The upper end of the mast is braced by means of a cable 21 having one end tied to the said upper end and its other end secured to the boat bottom. The cable may have a ball 22 connected to its said other end, the ball fitting through a round opening 23 of a keyhole slot 24 formed in a cleat 25, the latter being secured to the boat bottom by means of screws 26. The cable may be tightened by snugging the upper end thereof through openings 27 in the top of the mast and then tying a knot in the cable upper end. The cleat 25 is connected to the boat bottom, or any other suitable part of the boat, so that the cable 21 is disposed generally in a vertical plane with the longitudinal axis of the bar 10.

A cable 30 is threaded through openings 31 in the upper end of the mast 20 and the end of the cable legs are bunched together and secured to the bar 10 by a pipe clamp arrangement 32 as seen in FIG. 4. The cable 30 is made of Bungy cord or the like so as to provide vertical support for the bar 10 but with a slight stretch in the longitudinal direction so that a skier may move the free end of the bar downwardly against the tension of the cord 30. The tension may be increased by shortening the length of the cord 30 so that a skier must exert greater force to move the end of the bar downwardly. If the side of the boat is high enough out of the water, the mast 20 may be omitted and the top end of the cord 30 attached to the boat side in any desirable manner. In this case, the mounting plate 11 will be secured to the boat side a selected distance below the top end of the cord, but sufficiently above the water line so that the bar 10 is in position for use by a skier.

In order to brace the bar 10 against the pull generated by a skier, a cable 35 is attached to the bar inward of the free end of the latter by a clamp 36 in a manner shown in FIG. 5. The opposite end of the cable 35 is secured to the deck hook 37 of the boat, or to any other part of the boat at the bow thereof.

For trick skiing, a standard tow rope may be threaded through two holes 38 in the free end of the bar 10, with the surplus of rope at the end 39 returned to the boat for securement thereto, and the opposite end 40 connected to a ski baton 41 as seen in FIG. 1. A shorter tow rope may be used, if desired.

For most skiing purposes, the bar 10 may be about nine feet (about 2.7 meters) long, with the distances D and E about three feet (about 0.86 meters) long. The rope 40 should be about 2 to 3 (0.62 to 0.86 meters) long.

It will be appreciated that the components of my invention may be sold in kit form for application to any suitable power boat. When the bar 10 is not in use, it may be elevated to extend in a vertical position so that the boat has all the clearance it would have had, had the ski arrangement not been attached to it.

It will be appreciated that the skier is far enough away from the side of the boat so as not to be seriously affected by the wake of the traveling boat. Further, the skier is clear of the boat side but always visible to the boat operator in the event the skier runs into trouble. Since the skier is at the side of the boat, closeup photographs or movie films may be taken of the skier's actions.

I claim:

1. A water ski training aid apparatus for use with a boat, comprising:

a rigid mounting plate attached on the exterior hull of a boat on one side thereof and above the water level, said plate having means extending laterally outwardly thereon defining a horizontal pivot connection extending substantially fore and aft of the boat and parallel to the boat longitudinal axis when said plate is secured thereon, an elongated bar, said bar having one end thereof provided with attachment means for said plate horizontal pivot connection with the remainder of said bar extending laterally outwardly therefrom, thereby to permit said bar to swing substantially vertically up and down with respect to said mounting plate, and, flexible cable means connectable between a point on said bar outwardly thereof from said pivot connection and a point above said mounting plate thereby to restrain downward free swinging movement of said bar while permitting substantially unrestrained upward swinging thereof, whereby a training water skier when towed by said bar may pivot said bar vertically upwardly and downwardly as the boat may roll about its longitudinal axis, and thereby prevent the bar from descending into the water with resultant loss of training control.

2. The apparatus according to claim 1 further including a rigid mast extending upright from said mounting plate, and said cable connected between an upper portion of said mast and an intermediate portion of said bar.

3. The apparatus according to claim 2 and including a second cable means having its opposite ends connected between said upper mast portion and a part of said boat to brace said mast against vertical forces transmitted to the bar by the skier.

4. The apparatus according to claim 3 wherein said second cable means has a ball secured to the end connected to the boat, said ball releasably fitting within a keyhole slot in a bracket fixed to said boat, said mast having its lower end removably secured in a socket in said mounting plate, and said pivot connection comprising a pin extending through openings in said bar and said plate and removably secured in position, whereby said bar, said mast and said cable means may be readily assembled with or removed from said boat.

5. The apparatus according to claim 3 and including a third cable having its opposite ends connected to said bar and a portion of said boat forward of said bar, to brace against drag applied to said bar by the skier.

6. The apparatus in accordance with claim 1 wherein said flexible cable means is made of resilient and stretchable Bungy cord, thereby to permit downward swinging movement of said bar about said pivot connection beyond the normal relaxed length of said cord.

7. The apparatus of claim 1 wherein said bar has means therealong for attaching a skier's tow rope thereto.

* * * * *